United States Patent [19]

Hinton

[11] Patent Number: 4,530,460

[45] Date of Patent: Jul. 23, 1985

[54] PARTITIONED CONTAINER WITH COLLAPSIBLE BOTTOM

[75] Inventor: Gordon L. Hinton, Portland, Tenn.

[73] Assignee: Weyerhaeuser Company, Tacoma, Wash.

[21] Appl. No.: 622,526

[22] Filed: Jun. 20, 1984

[51] Int. Cl.[3] ..... B65D 5/48

[52] U.S. Cl. ..... 229/27; 229/41 B; 229/52 B

[58] Field of Search ..... 229/27, 52 B, 41 R, 229/41 B, 15, 52 BC; 206/170, 171, 172, 173, 174, 175, 193, 198

[56] References Cited

U.S. PATENT DOCUMENTS

| | | | |
|---|---|---|---|
| 2,332,250 | 10/1943 | O'Reilly | 229/41 |
| 2,543,821 | 3/1951 | Arneson | 229/27 X |
| 2,643,811 | 6/1953 | Bolding | 229/27 |
| 2,881,946 | 4/1959 | Bosrock et al. | 229/27 X |
| 2,914,237 | 11/1959 | Malmad | 229/41 |
| 3,199,762 | 8/1965 | Coons | 229/27 |
| 3,394,863 | 7/1968 | Wood et al. | 229/27 |
| 3,836,065 | 9/1974 | Hackenberg | 229/27 |
| 3,860,113 | 1/1975 | Helms | 229/52 BC |
| 3,942,710 | 3/1976 | Collie | 229/27 X |
| 4,134,495 | 1/1979 | Friedman | 229/27 X |
| 4,293,091 | 10/1981 | Gerard | 229/27 |
| 4,398,661 | 8/1983 | Schillinger | 229/27 |
| 4,487,358 | 12/1984 | Ambrose | 229/27 |

FOREIGN PATENT DOCUMENTS

| | | | |
|---|---|---|---|
| 576178 | 5/1959 | Canada | 206/175 |
| 597956 | 5/1960 | Canada | 229/52 B |
| 1211056 | 3/1960 | France | 206/193 |
| 2300711 | 10/1976 | France | 229/52 B |
| 675283 | 7/1952 | United Kingdom | 229/52 B |
| 1192032 | 5/1970 | United Kingdom | 229/27 |

*Primary Examiner*—William Price
*Assistant Examiner*—Gary E. Elkins

[57] ABSTRACT

A container having automatic locking closure and a central divider provided with a handle to allow easy carrying and which also allows overlapping side panels to increase the stacking strength of the container. The central divider also has a lower edge in the container to allow the automatic locking closure to extend into the container when the container is flat.

4 Claims, 7 Drawing Figures

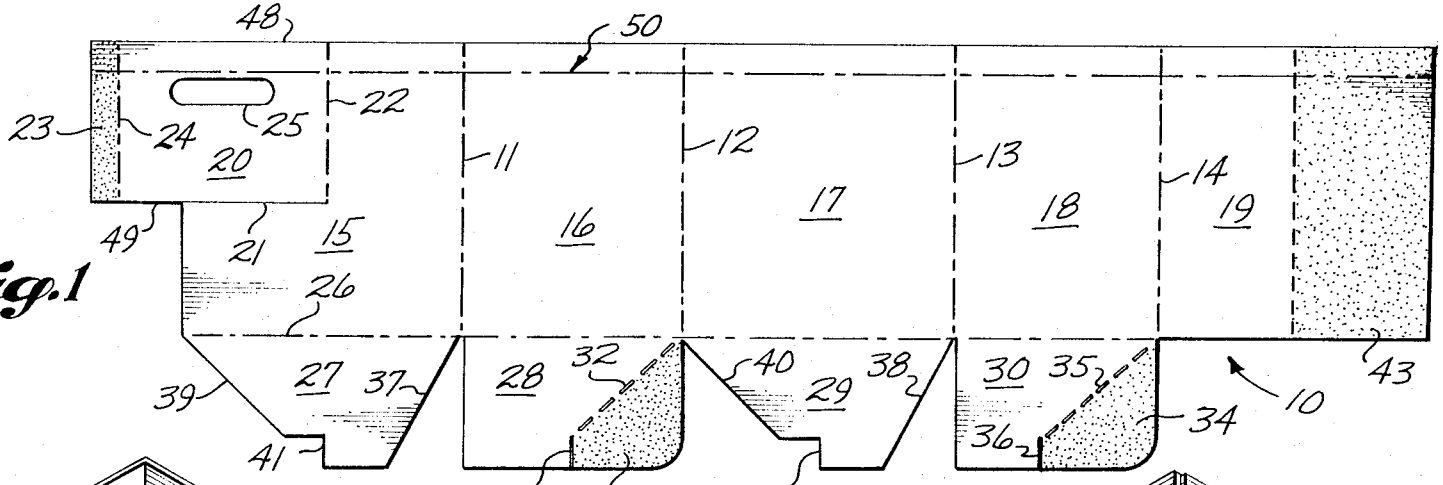
Fig. 1
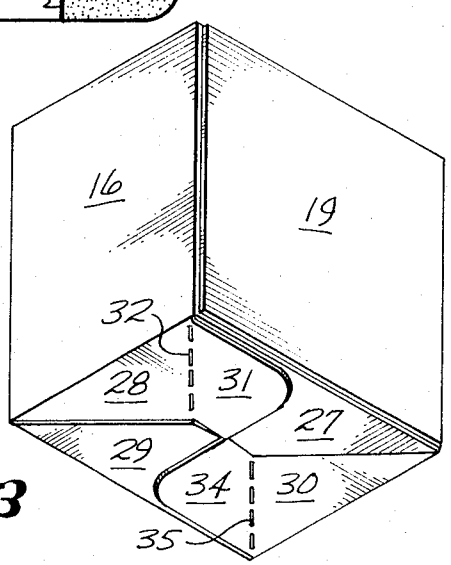
Fig. 2
Fig. 3

PARTITIONED CONTAINER WITH COLLAPSIBLE BOTTOM

BACKGROUND OF THE INVENTION

There are a number of patents that show internal dividers and containers. Three such patents are Bolding, U.S. Pat. No. 2,643,811 granted June 30, 1953; Coons, U.S. Pat. No. 3,199,762 granted Aug. 10, 165 and Gerard, U.S. Pat. No. 4,293,091 granted Oct. 6, 1981.

There are also patents showing automatic bottom closures. Three such patents are O'Reilly, U.S. Pat. No. 2,332,250 granted Oct. 19, 1943; Malmad, U.S. Pat. No. 2,914,237 granted Nov. 24, 1959 and Hackenberg, U.S. Pat. No. 3,836,065 granted Sept. 17, 1974.

SUMMARY OF THE INVENTION

A container was required that would be easy to set up without the need of glue or tape, would have an integral handle and would have increased stacking strength. The inventor devised a container having an automatic locking closure and a central divider which was provided with a handle to allow easy carrying and which also allowed overlapping side panels to increase the stacking strength of the container. The lower edge of the divider panel is between the upper and lower edges of the side panels to allow the closure panels to extend into the container when the container is in lay flat condition.

BRIEF DESCRIPTION OF THE DRAWINGS

FIG. 1 is a top plan view of a blank for the container.

FIGS. 2 and 3 are isometric views of the formed and erected container. FIG. 2 is a top view and FIG. 3 a bottom view.

FIG. 5 is a top view and FIG. 6 is a bottom view.

DESCRIPTION OF THE PREFERRED EMBODIMENTS

Figures 4, 5, 6, 7:
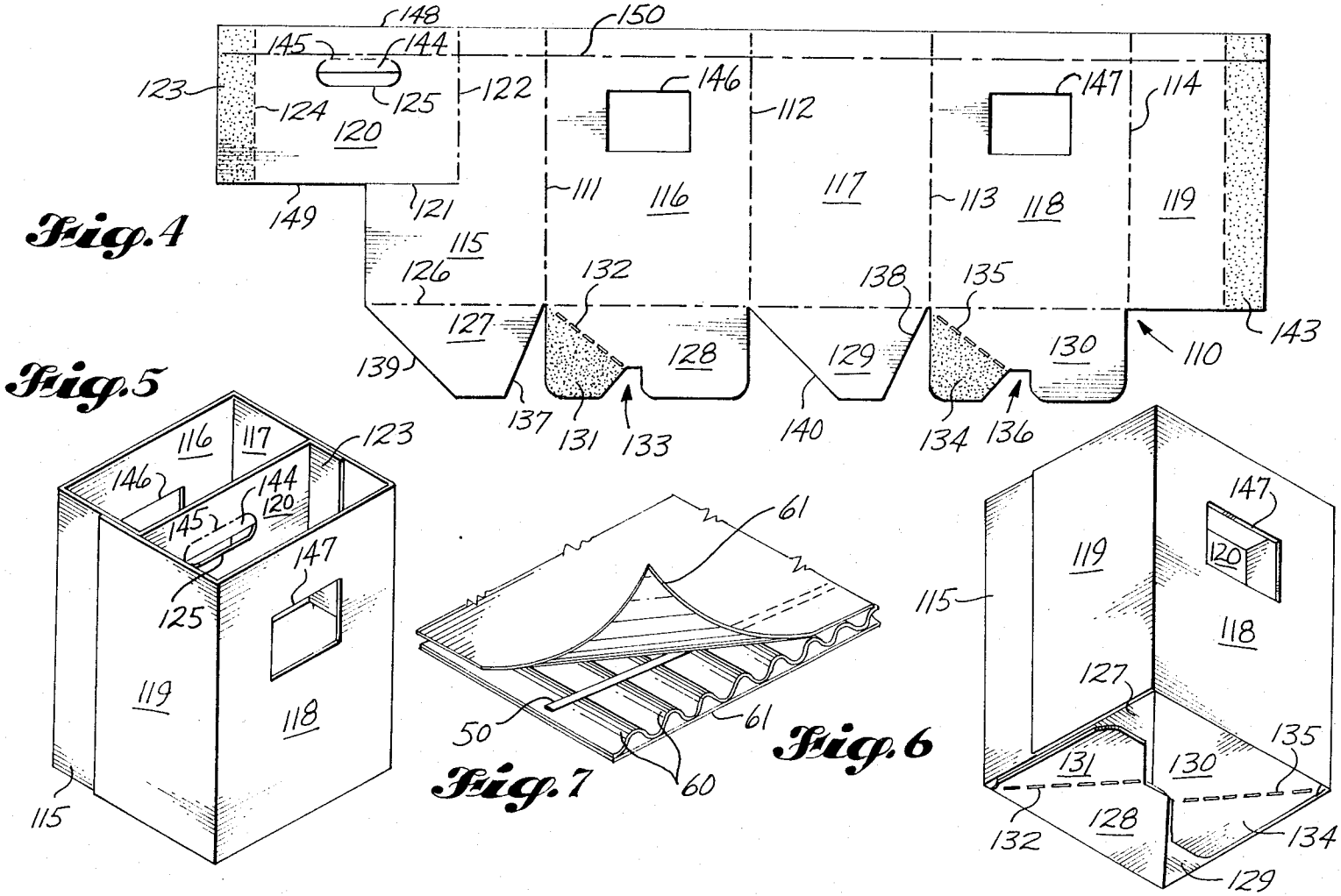
FIG. 4 is a top plan view of a blank for a modified container.
FIGS. 5 and 6 are isometric views of the formed and erected container.
FIG. 7 is an isometric view showing the placement of a reinforcing tape between the flutes and one of the facings of the corrugated board.

The blank for the container is shown in FIG. 1. The blank 10 is divided by score lines 11, 12, 13 and 14 into a first side panel 15, a second side panel 16, a third side panel 17, a fourth side panel 18 and a fifth side panel 19. The first, third and fifth side panels 15 and 17 are of the same width; and the second and fourth side panels 16 and 18 are of the same width.

A divider panel 20 is separated from the first side panel 15 by slit 21. Panel 20 is attached to first side panel 15 by score line 22. An outer glue flap 23 is attached to panel 20 by score line 24. The divider panel 20 extends beyond the outer side edge of panel 15. A hand hold 25 is formed in divider panel 20.

The width of divider panel 20 between score lines 22 and 24 is equal to the width of side panel 16 between score lines 11 and 12.

The lower closure panels are attached to the side panels along score line 26. First closure panel 27 is attached to first side panel 15. Second closure panel 28 is attached to second side panel 16. Third closure panel 29 is attached to third side panel 17. Fourth closure panel 30 is attached to fourth side panel 18.

Glue flaps are attached to second closure panel 28 and fourth closure panel 30. A first glue flap 31 is attached to second closure panel 28 along the oblique score line 32 which extends from an inner corner of the panel 28 to a position near the outer edge of panel 28. A slit 33 extends from the outer end of score line 32 to the outer edge of panel 28 and is substantially perpendicular to score line 26. A second glue flap 34 is attached to fourth closure panel 30 along the oblique score line 35 and is separated from the panel 30 by slit 36. The score line 35 and slit 36 are identical to the score line 32 and slit 33 in the second closure panel 28. The side edges 37, 38, 39 and 40 of first and third closure panels 27 and 29 are oblique to allow easy closure of the panels. The base of panels 27 and 29, along score line 26, is larger than the outer edge of the panels. Side edges 37 and 38 extend toward side edges 39 and 40. Edges 37 and 38 are at the same angle to score line 26, and edges 39 and 40 are at the same angle to score line 26. Locking elements 41 and 42 are also formed in the closure panels 27 and 29.

In forming the container, glue is placed on the glue flaps 23, 31, 34 and the glue section 43 of side panel 19. The closure panels 27, 28, 29 and 30 are bent inwardly around the score line 26 to overlie the side panels 15, 16, 17 and 18. At the same time the glue flaps 31 and 34 are bent outwardly so that the glued surfaces of flaps 31 and 34 face upwardly. Panel 15 and its associated panels 20 and 27 are then bent inwardly around score line 11 until the panels overlie panels 16 and 28. The glue flap 31 adheres to closure panel 27 and glue flap 23 adheres to side panel 17. Panels 18, 19 and 30 are then bent inwardly around score line 13 causing glue flap 34 to adhere to closure panel 29 and glue section 43 to adhere to side panel 15.

When the container is flat, the closure panels 27, 28, 29 and 30 extend into the lower end of the container. The divider panel 20 is shorter than the side panels 15, 16, 17, 18 and 19 to allow this. The upper edge 48 of the divider panel 20 is aligned with the upper edges of the side panels. However, the lower edge 49 of the divider panel is between the upper and lower edges of the side panels and is high enough in the container to allow the closure panels to fold into the container when the container is folded flat. The lower edge 49 will be above the glued sections 31 and 34.

When the container is squared as shown in FIGS. 2 and 3, the closure panels will open inwardly and downwardly and form a closure across the bottom of the container, and the divider panel 20 will provide a hand hold 25 for the container.

The hand hold 25 is reinforced with a sesame tape or an equivalent reinforcing tape 50. The tape 50 extends longitudinally of the container blank 10, and is between the upper edge of hand hold 25 and the upper edge 48 of the divider panel 20. It would be placed between the flutes 60 and one of the facing liners 61 as shown in FIG. 7.

A modification is shown in FIGS. 4–6. The blank 110 is divided by score lines 111, 112, 113 and 114 into a first side panel 115, a second side panel 116, a third side panel 117, a fourth side panel 118 and a fifth side panel 119. The first and third side panels 115 and 117 are of the same width; and the second and fourth side panels 116 and 118 are of the same width.

Divider panel 120 is again separated from first side panel 115 by slit 121 and is attached to first side panel 115 along score line 122. A glue flap 123 is attached to the outer side edge of panel 120 along score line 124. The panel 120 extends beyond the outer side edge of panel 115. The width of divider panel 120 between score lines 122 and 124 is equal to the width of side panel 116 between score lines 111 and 112. A hand hold 125 is formed in panel 120 and reinforcing hand hold flap 144 is attached to the upper edge of hand hold 125 along score line 145. Again the lower edge 149 of the divider panel 120 is within the container to allow the closure panels to fold into the container when the container is flat.

There is also a longitudinal reinforcing tape 150 located between the upper score line 145 of hand hold 125 and the upper edge 148 of divider panel 120. It reinforces the hand hold 125 and is sesame tape or an equivalent reinforcing tape. It is also located between the flute and facing liners of the corrugated board as shown in FIG. 7.

The lower closure panels are attached to the side panels along score line 126. First closure panel 127 is attached to first side panel 115. Second closure panel is attached to second side panel 116. Third closure panel 129 is attached to third side panel 117. Fourth closure panel 130 is attached to fourth side panel 118.

A pair of glue flaps are attached to the second and fourth closure panels 128 and 130. First glue flap 131 is attached to the second closure panel 128 along an oblique score line 132. Score line 132 extends from an inner corner of the panel 128 to an inner edge of the relief 133 formed in the outer edge of panel 128. Glue flap 134 is attached to panel 130 along oblique score line 135 which extends from an inner corner of panel 130 to the inner edge of the relief 136 formed in the outer edge of panel 130. Score lines 132 and 135 are identical and reliefs 133 and 136 are identical.

The first and third closure panels 127 and 129 again have oblique side edges 137, 138, 139 and 140 to aid the closure of the container. The base of panels 127 and 129, along score line 126, is larger than the outer edge of the panels. Edges 137 and 138 extend toward edges 139 and 140. Edges 137 and 138 are at the same angle to score line 126, and edges 139 and 140 are at the same angle to score line 126.

The blank of FIG. 4 is formed in the same manner as the blank of FIG. 1.

The glue section 143 is narrower than glue section 43 because the side wall 119 does not extend the entire width of side wall 115. When the container is carried, the flap 144 is bent upwardly to provide reinforcement for the hand hold 125. There are apertures 146 and 147 in the side walls 116 and 118, parallel to the divider flap 120 in the formed container. This allows the identification on the product carried within the container to be seen.

I claim:

1. A blank for a container comprising first, second, third, fourth and fifth side panels serially connected by first, second, third and fourth score lines, said first and third side panels being of equal width, said second and fourth side panels being of equal width, a divider panel attached to said first panel by a fifth score line, a glue flap attached to the outer side edge of said divider panel by a sixth score line, the width of said divider panel between said fifth and sixth score lines being equal to the width of said second side panel, said fifth said panel having a maximum width equal to the width of said first side panel and a minimum width greater than the distance between the free side edge of said first panel and said fifth score line, a hand hold in said divider panel, said divider panel havng a lower edge that is between the upper and lower edges of said first panel and being separated from said first side panel by a slit, first, second, third and fourth bottom closure panels attached to the lower edge of said first, second, third and fourth side panels by a seventh score line, the outer edge of said first and third bottom closure panels being parallel to said seventh score line, the side edges of said first and third bottom closure panels being oblique and extending toward each other in the direction of said outer free edge, glue flaps attached to said second and fourth bottom closure panels by oblique score lines which extend from an inner corner of said second and fourth bottom closure panels, said glue flaps being attached to said second and fourth bottom closure panels only along said oblique score line.

2. The blank of claim 1 further comprising said hand hold having an upper edge, said divider panel having an upper edge, a reinforcing tape extending longitudinally of said blank, said tape being between said upper edge of said hand hold and said upper edge of said divider panel.

3. A container comprising first, second, third, fourth and fifth side panels serially connected by first, second, third and fourth score lines, said first and third side panels being of equal width, said second and fourth side panels being of equal width, a divider panel attached to said first side panel by a fifth score line and attached to said third side panel by a glue flap, a hand hold in said divider panel, said fifth side panel being adhered to said first side panel between said fifth and first score lines, first, second, third and fourth bottom closure panels attached to said first, second, third and fourth side panels, said second and fourth bottom closure panels each having a glue flap attached thereto by an oblique score line extending from an inner corner of said second and fourth closure panels, said glue flaps being attached to said second and fourth bottom closure panels only along said oblique score line, said glue flaps being adhered to said first and third closure panels respectively, the bottom edge of said divider panel being between the upper and lower edges of said side panels to allow said bottom closure panels to extend into said container when said container is flat.

4. The container of claim 3 further comprising said hand hold having an upper edge, said divider panel having an upper edge, a reinforcing tape extending horizontally of said divider panel between said upper edge of said hand hold and said upper edge of said divider panel.

* * * * *

UNITED STATES PATENT AND TRADEMARK OFFICE

CERTIFICATE OF CORRECTION

PATENT NO. : 4,530,460

DATED : July 23, 1985

INVENTOR(S) : Gordon L. Hinton

It is certified that error appears in the above—identified patent and that said Letters Patent is hereby corrected as shown below:

In Column 4, line 6, "fifth said panel" should read --fifth side panel--.

Signed and Sealed this

*Tenth* Day of *December 1985*

[SEAL]

*Attest:*

DONALD J. QUIGG

*Attesting Officer*

*Commissioner of Patents and Trademarks*